US006258172B1

(12) United States Patent
Foster et al.

(10) Patent No.: US 6,258,172 B1
(45) Date of Patent: Jul. 10, 2001

(54) METHOD AND APPARATUS FOR BORONIZING A METAL WORKPIECE

(76) Inventors: Gerald Allen Foster, P.O. Box 28, Sunnybrook, Alberta (CA), T0C 2M0; Dale William MacKenzie, P.O. Box 611, Breton, Alberta (CA), T0C 0P0

( * ) Notice: Subject to any disclaimer, the term of this patent is extended or adjusted under 35 U.S.C. 154(b) by 0 days.

(21) Appl. No.: 09/430,358

(22) Filed: Oct. 28, 1999

(30) Foreign Application Priority Data

Sep. 17, 1999 (CA) ..... 2282771

(51) Int. Cl.[7] ..... C23C 16/00
(52) U.S. Cl. ..... 118/717; 118/724; 118/725
(58) Field of Search ..... 118/717, 724, 118/725, 726

(56) References Cited

U.S. PATENT DOCUMENTS

| | | | | |
|---|---|---|---|---|
| 3,391,270 | * | 7/1968 | Harris et al. | 118/725 |
| 3,515,095 | * | 6/1970 | Baranow et al. | 118/48 |
| 3,607,368 | * | 9/1971 | Amstel | 117/106 |
| 3,608,519 | * | 9/1971 | Richardson et al. | 118/48 |
| 3,645,230 | * | 2/1972 | Hugle et al. | 118/49.5 |
| 3,952,945 | | 4/1976 | Biddulph | 236/15 R |
| 4,446,817 | * | 5/1984 | Crawley | 118/725 |
| 4,495,005 | | 1/1985 | Aves, Jr. | 148/217 |
| 4,495,006 | | 1/1985 | Aves, Jr. | 148/217 |
| 4,655,851 | | 4/1987 | Loos | 148/214 |
| 4,794,200 | * | 12/1988 | Tordeux et al. | 570/170 |
| 4,810,532 | | 3/1989 | Lavendel et al. | 427/255.1 |
| 4,928,477 | | 5/1990 | Kalitzki et al. | 57/416 |
| 4,969,378 | | 11/1990 | Lu et al. | 76/108.2 |
| 4,975,147 | * | 12/1990 | Tahara et al. | 156/646 |
| 4,993,359 | * | 2/1991 | Lewis et al. | 118/717 |
| 5,372,654 | | 12/1994 | Satoh et al. | 148/217 |
| 5,372,686 | * | 12/1994 | Timberlake et al. | 204/192.15 |
| 5,455,068 | | 10/1995 | Aves, Jr. et al. | 427/237 |
| 5,651,826 | * | 7/1997 | Takagi | 118/724 |

FOREIGN PATENT DOCUMENTS

| | | | |
|---|---|---|---|
| 1796216 | 4/1972 | (NL) | C23C/13/00 |

OTHER PUBLICATIONS

Boronizing, Alfred Graf von Matuschka, Carl hanser Verlag Munchen Wien, 1980, pp. 44–49, along with page containing bibliographic information and page containing table of contents.

* cited by examiner

*Primary Examiner*—Jeffrie R. Lund
(74) *Attorney, Agent, or Firm*—Christensen O'Connor Johnson Kindness PLLC

(57) ABSTRACT

A method and apparatus for boronizing a metal workpiece which includes the step of providing a container having a least one workpiece receiving chamber and at least one heating chamber adapted to heat the workpiece receiving chamber. The metal workpiece to be boronized is placed within the workpiece receiving chamber in physical contact with a boronizing agent. The heating chamber is heated until the workpiece receiving chamber is heated to a sufficient temperature for a sufficient length of time to boronize the workpiece. With this method an internal heating chamber positioned within the container is used to supply heat for the boronizing process, as opposed to placing the container into a boronizing furnace. This eliminates the need for a boronizing furnace, with all of its associated expense.

9 Claims, 9 Drawing Sheets

METHOD AND APPARATUS FOR BORONIZING A METAL WORKPIECE

FIELD OF THE INVENTION

The present invention relates to a method for boronizing a metal workpiece and an apparatus that has been developed for use in accordance with the teachings of the method.

BACKGROUND OF THE INVENTION

Boronizing is a process by means of which a wear and corrosion resistant coating is formed at a surface of a metal workpiece. The coating consists of a metal boride, such as an iron boride FeB or $Fe_2B$.

A typical boronizing process involves placing a metal workpiece to be boronized in a container. The container is then filled with a powdered mixture of materials from which the boron needed for the thermochemical reaction is derived. The container is placed within a large furnace and the contents of the furnace are heated to a selected temperature. Upon heating, the powdered materials react with the surface of the metal workpiece to form a boride coating as a protective layer. When a sufficient time has elapsed for the coating to be completely formed as a strong integral layer about the workpiece, the container is cooled and emptied. The boronized workpieces are removed for inspection, testing, cleaning and further heat treatment, if needed. Spent powdered materials are discarded or recycled to the extent possible.

Setting up a boronizing facility is a capital intensive endeavour due to the high capital cost of acquiring or constructing the furnaces that are required for the process. In addition, such boronizing facilities have high operational costs associated with the operation of the furnaces.

SUMMARY OF THE INVENTION

What is required is a less costly method for boronizing a workpiece.

According to the present invention there is provided a method for boronizing a metal workpiece which includes the following steps. A container is provided having a least one workpiece receiving chamber and at least one heating chamber adapted to heat the workpiece receiving chamber. The metal workpiece to be boronized is placed within the workpiece receiving chamber in physical contact with a boronizing agent. The heating chamber is heated until the workpiece receiving chamber is heated to a sufficient temperature for a sufficient length of time to boronize the workpiece.

With the method, as described above, an internal heating chamber positioned within the container is used to supply heat for the boronizing process, as opposed to placing the container into a boronizing furnace. This eliminates the need for a boronizing furnace, with all of its associated expense. Once the basic teaching of the method is understood, the container can be made in various ways. The workpiece receiving chamber is made to accommodate the geometry of the work pieces being boronized. There are various means for heating the internal cavity of the container. The embodiment hereinafter described is for purposes of illustration only.

According to another aspect of the invention there is provided an apparatus for boronizing a metal workpiece which includes a male housing and a female housing. The male housing contains a heating chamber. The female housing has a sidewall defining an internal cavity. The male housing is insertable into the interior cavity of the female housing to form an annular workpiece receiving chamber between the male housing and the sidewall of female housing. In the embodiment which will hereinafter be described an internal heat source is disposed within the heating chamber. It will be appreciated that the heat source could be external to the apparatus and merely channel heat into the heating chamber.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method for boronizing a workpiece will now be described with reference to FIGS. 1 through 14.

Figure 1:
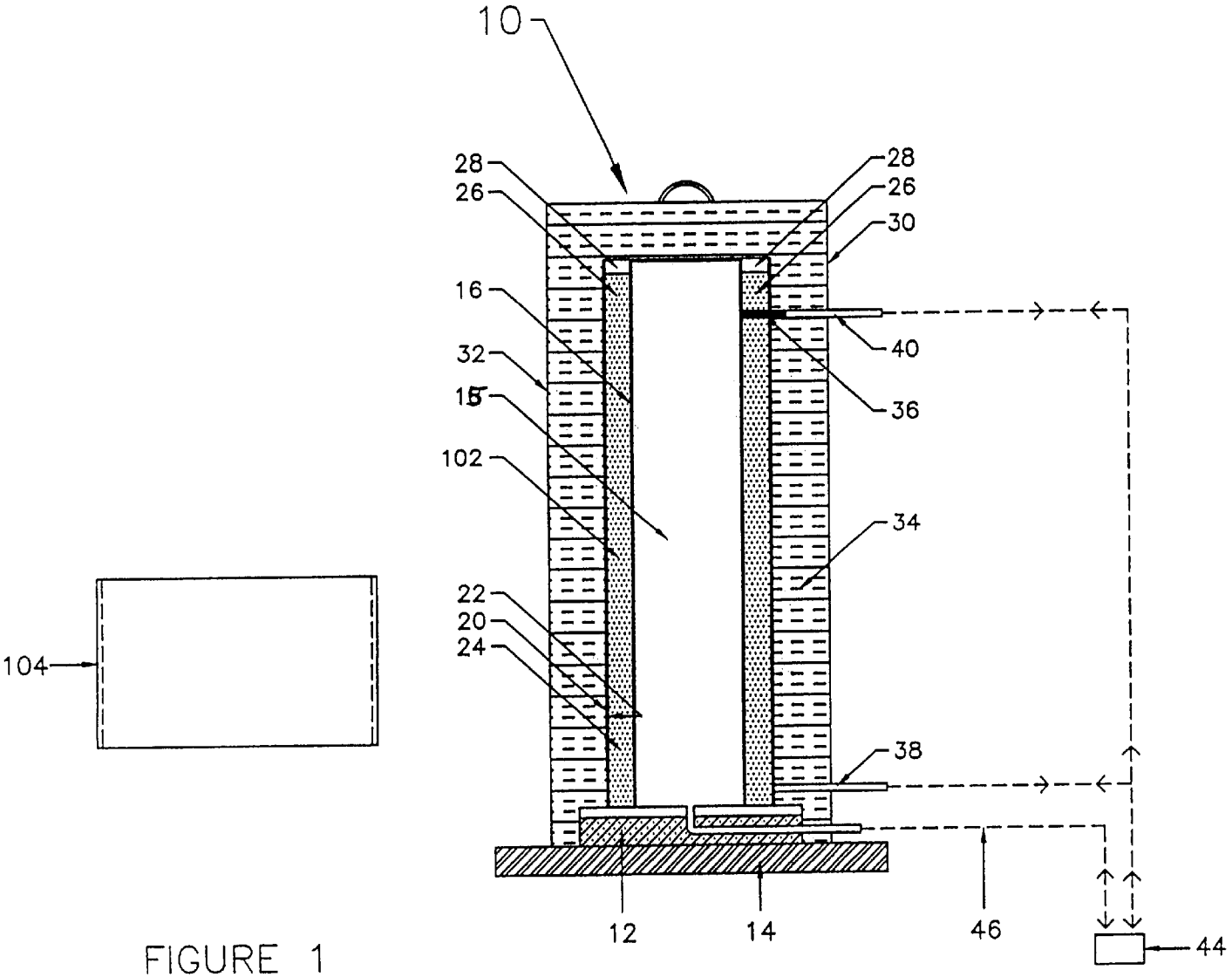
FIG. 1 is a side elevation view, in section, of a preferred embodiment of boronizing apparatus constructed in accordance with the teachings of the present method.
Figure 2:
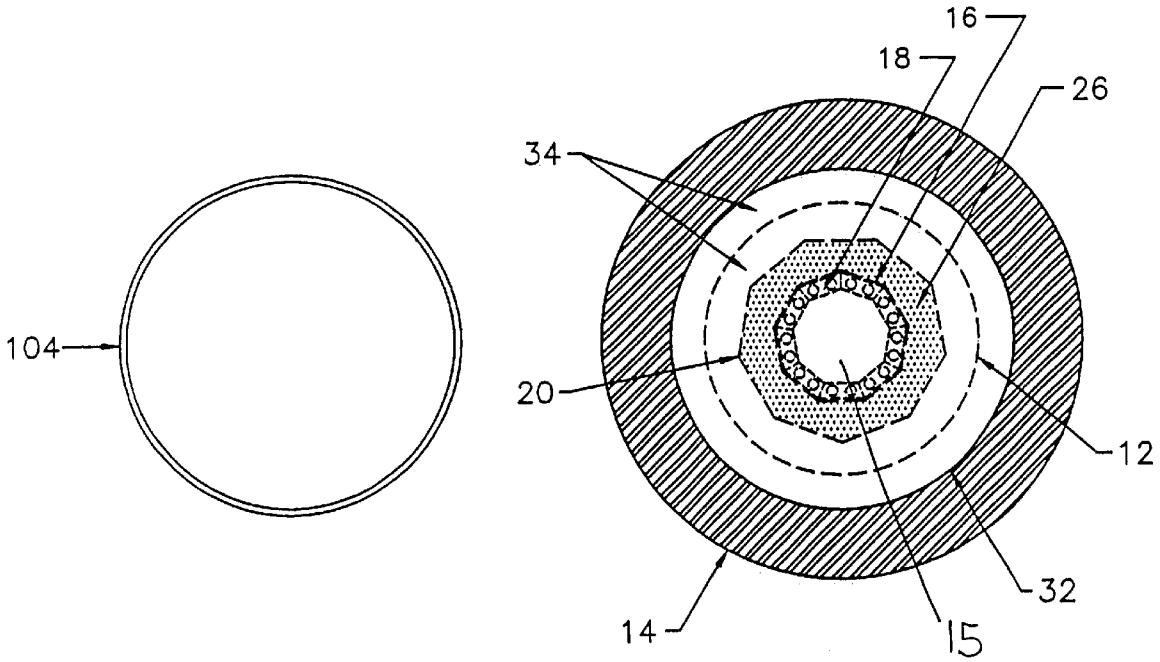
FIG. 2 is a top plan view, in section, of the boronizing apparatus illustrated in FIG. 1.
Figure 3:
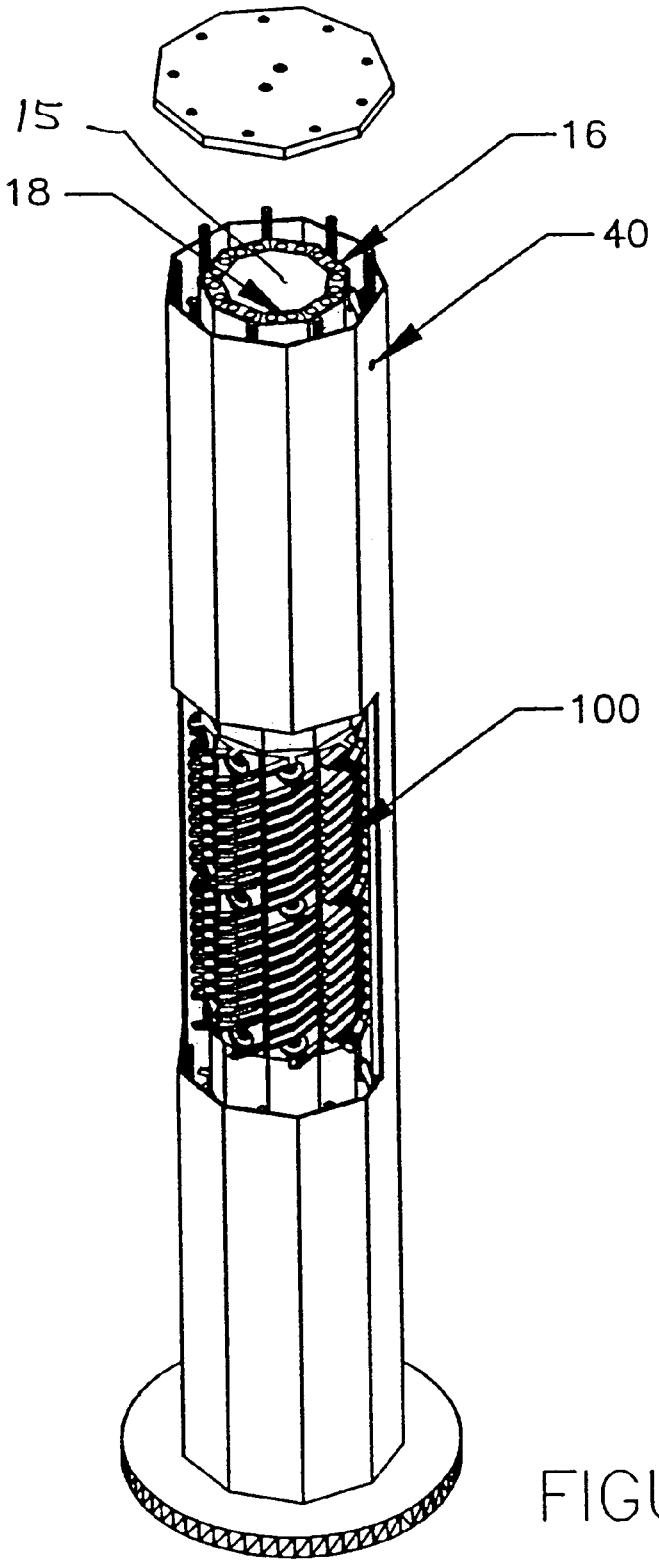
FIG. 3 is a partially cut away, perspective view of the boronizing apparatus illustrated in FIG. 1.
Figure 4:
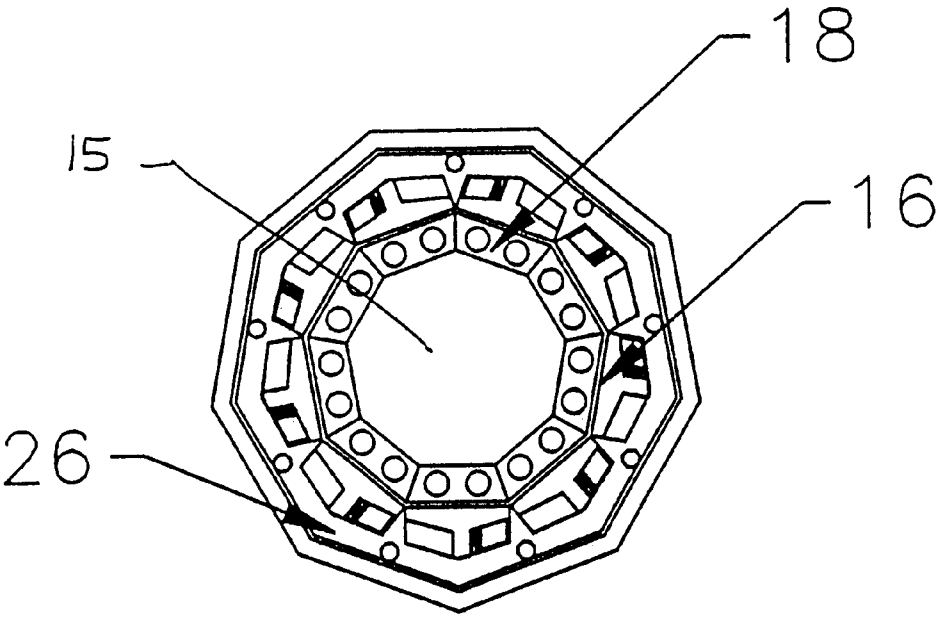
FIG. 4 is an end elevation view of the boronizing apparatus illustrated in FIG. 1.

Referring to FIG. 1, an apparatus for boronizing a metal workpiece constructed in accordance with the teachings of the preferred method is illustrated and generally identified by reference numeral 10. Apparatus 10 has an insulated base 12 set upon a steel plate footing 14. A heat resistant male housing 16 is mounted in an upright orientation to base 12. Male housing 16 is heat resistant to temperatures in the range of 1000 degrees celsius. Referring to FIGS. 3 and 4, several electric heating elements 18 are disposed within a heating chamber 15 formed in male housing 16. Referring to FIG. 1, a heat resistant female housing 20 is provided which has a sidewall 22 defining an internal cavity 24. Female housing 20 is heat resistant to temperatures in the range of 1000 degrees celsius. Female housing 20 overlies male housing 16 with male housing 16 positioned in internal cavity 24. This leaves an annular workpiece receiving chamber 26 between male housing 16 and sidewall 22 of female housing 20. A gravity seal is formed between female housing 20 and insulated base 12. A closure 28 in the form of an annular weighted slug, is used to close annular workpiece receiving chamber 26. A removable insulating covering, generally identified by reference numeral 30, overlies female housing 20. Insulating covering 30 consists of an a bell structure 32 with several internal layers of insulation 34. Apparatus 10 will have to operate at temperatures exceeding 900 degrees celsius for an extended period of time. Insulation 30 serves to conserve heat energy and reduce the temperature of bell structure 32 to make a safer environment for persons working in the vicinity of apparatus 10. Two temperature sensors are provided in the form of thermocouple 36 and 38. Thermocouple 36 is positioned in a first heat resistant thermowell 40 which extends through insulating covering 30 to male housing 16, and serves to monitor the temperature of male housing 16. Thermocouple 38 extends through insulating covering 30 to female housing 20, and serves to monitor the temperature of female housing 20. Thermocouple 36 and 38 are connected to a programmable controller 44 which also controls electrical input to electric heating elements 18 through electrical conduit 46.

Figure 5:
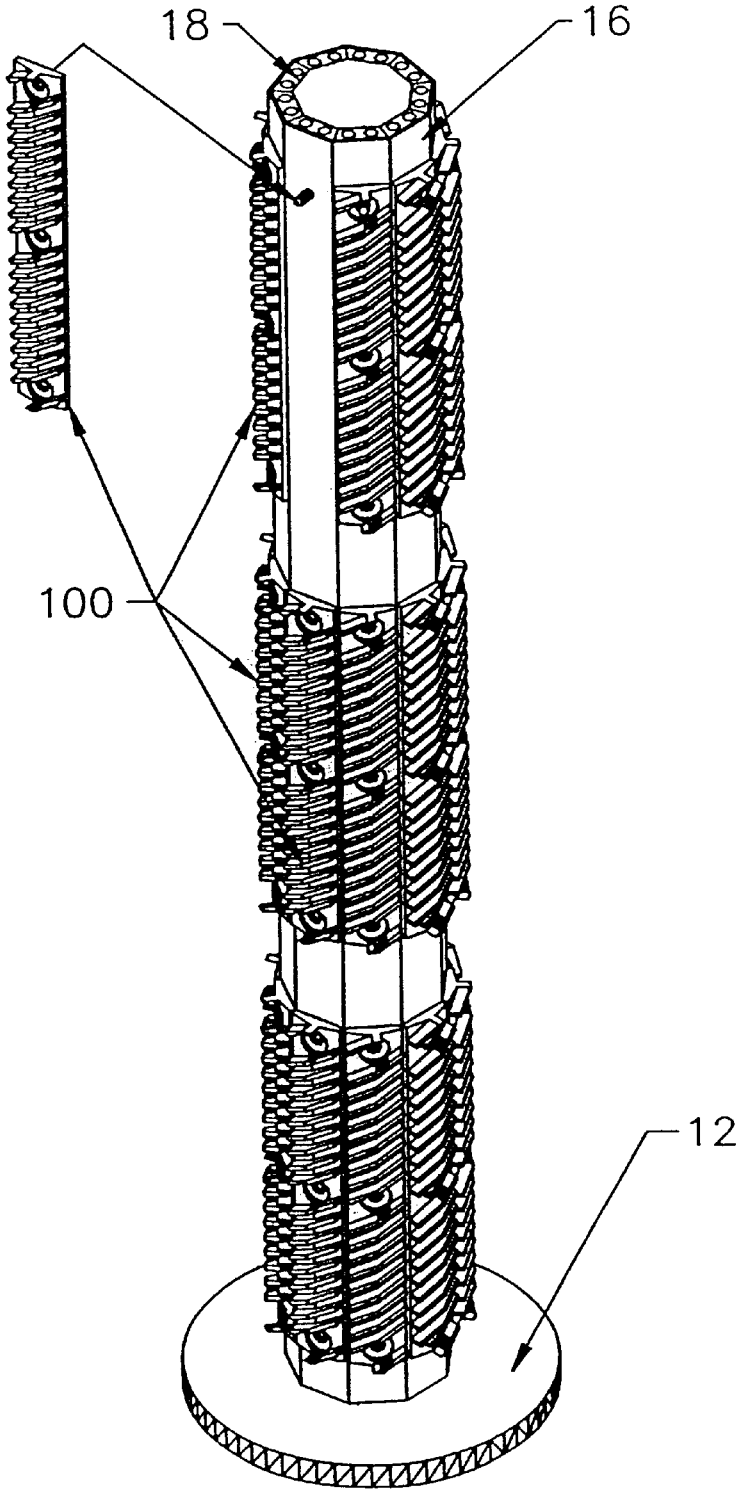
FIG. 5 is a perspective view of the male housing from the boronizing apparatus illustrated in FIG. 1, showing workpieces being mounted to the male housing.
Figure 6:
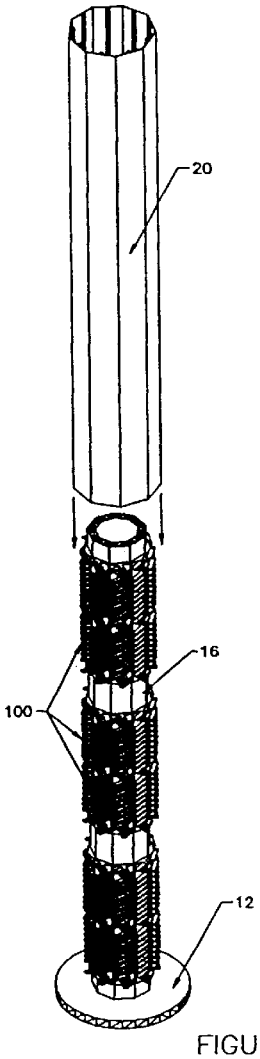
FIG. 6 is a perspective view of the boronizing apparatus illustrated in FIG. 5, showing a female housing being positioned to overlie the male housing.
Figure 7:
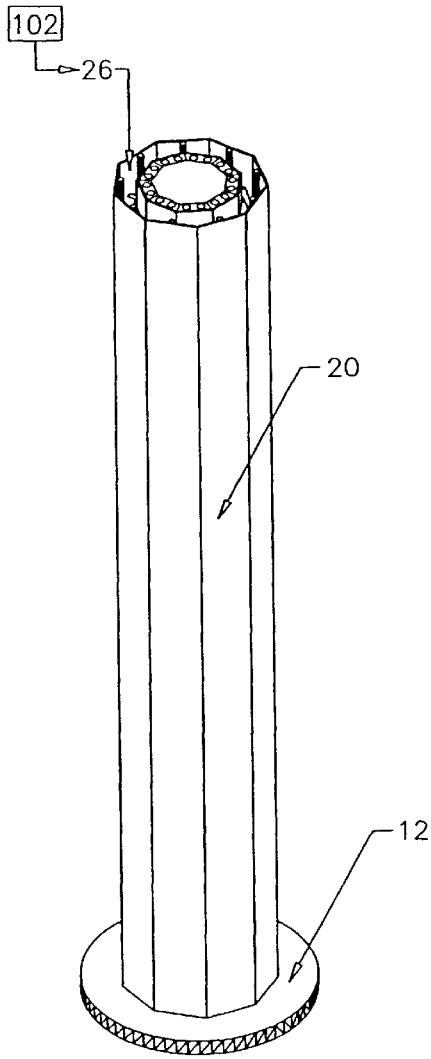
FIG. 7 is a perspective view of the boronizing apparatus illustrated in FIG. 6, showing the apparatus ready to receive boronizing powder in the annular workpiece receiving chamber between the male housing and the female housing.
Figure 8:
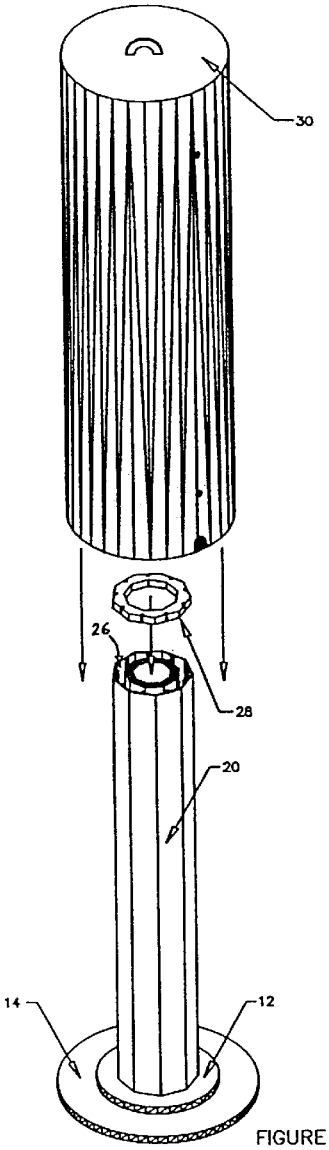
FIG. 8 is a perspective view of the boronizing apparatus illustrated in FIG. 7, showing an end closure being positioned to close the annular workpiece receiving chamber and an insulating covering being positioned to overlie the female housing.
Figure 9:
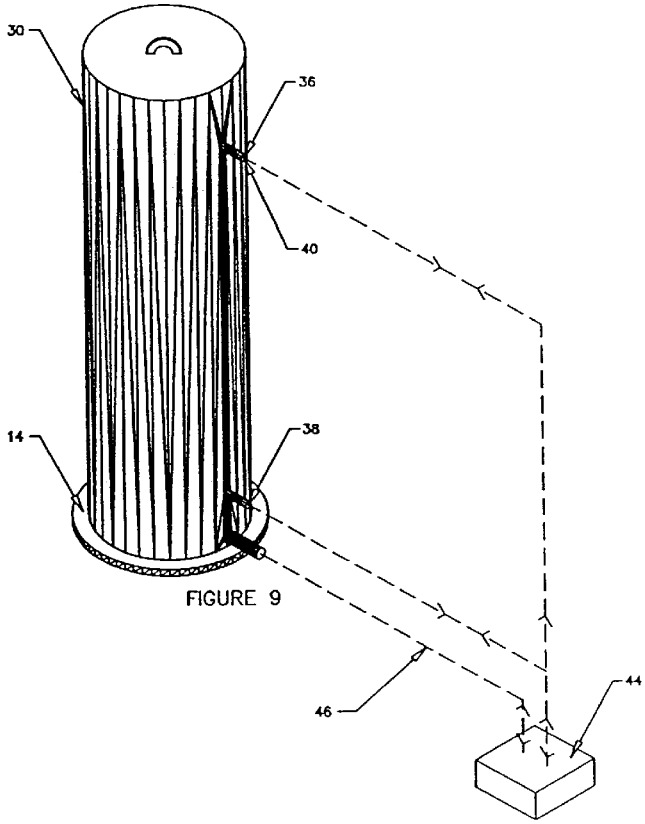
FIG. 9 is a perspective view of the boronizing apparatus illustrated in FIG. 8, showing connections being made to temperature sensors and controllers prior to commencement of the boronizing cycle.
Figure 10:
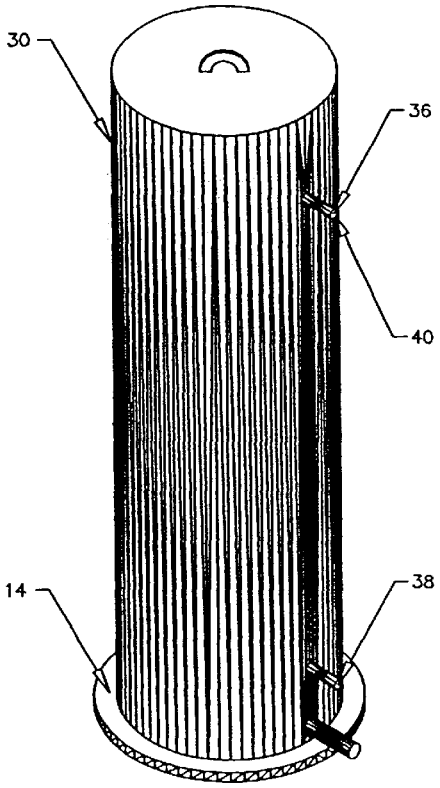
FIG. 10 is a perspective view of the boronizing apparatus illustrated in FIG. 9, showing temperature sensors and controllers being disconnected after the boronizing cycle.
Figure 11:
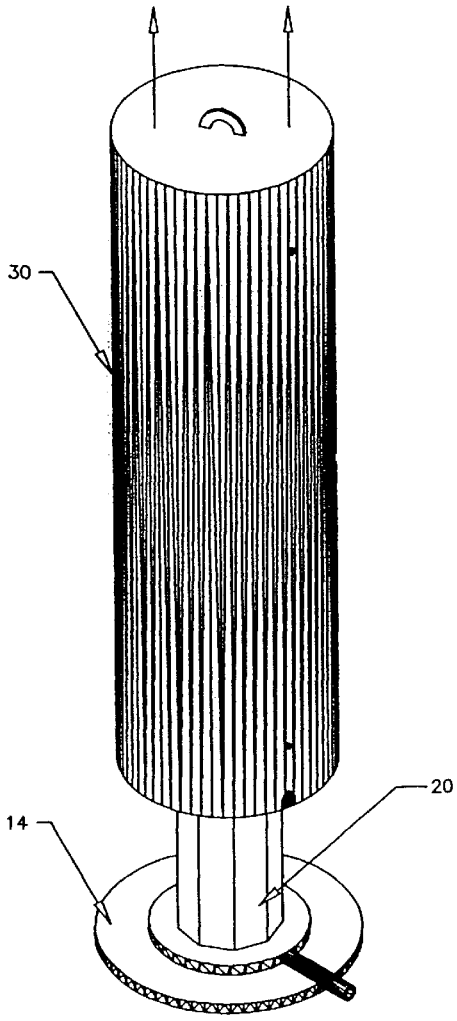
FIG. 11 is a perspective view of the boronizing apparatus illustrated in FIG. 10, showing the insulating covering being removed from the female housing after the boronizing cycle.
Figure 14:
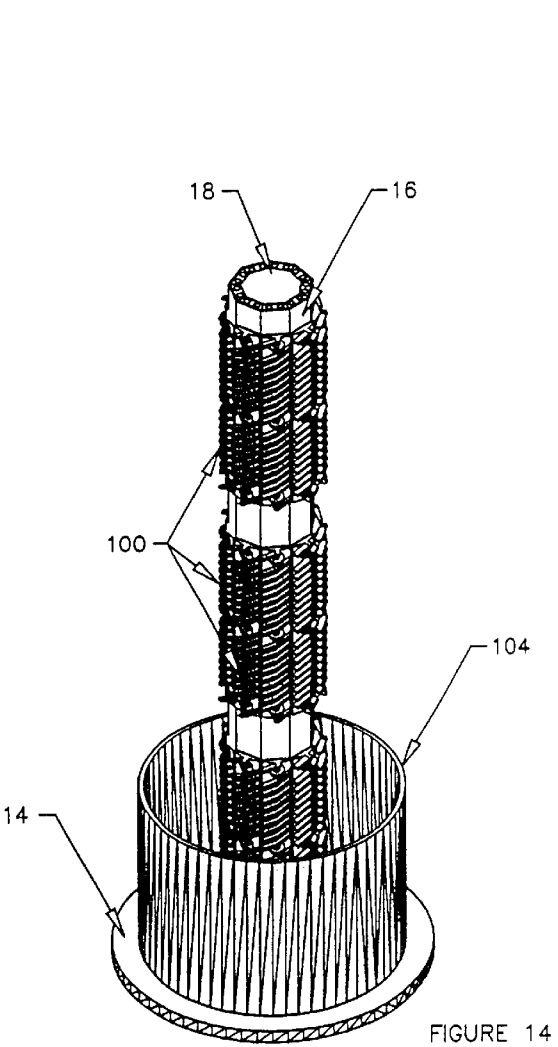
FIG. 14 is a perspective view of the boronizing apparatus illustrated in FIG. 13, showing the male housing with treated metal workpieces ready for removal after the boronizing cycle.
Figure 13:
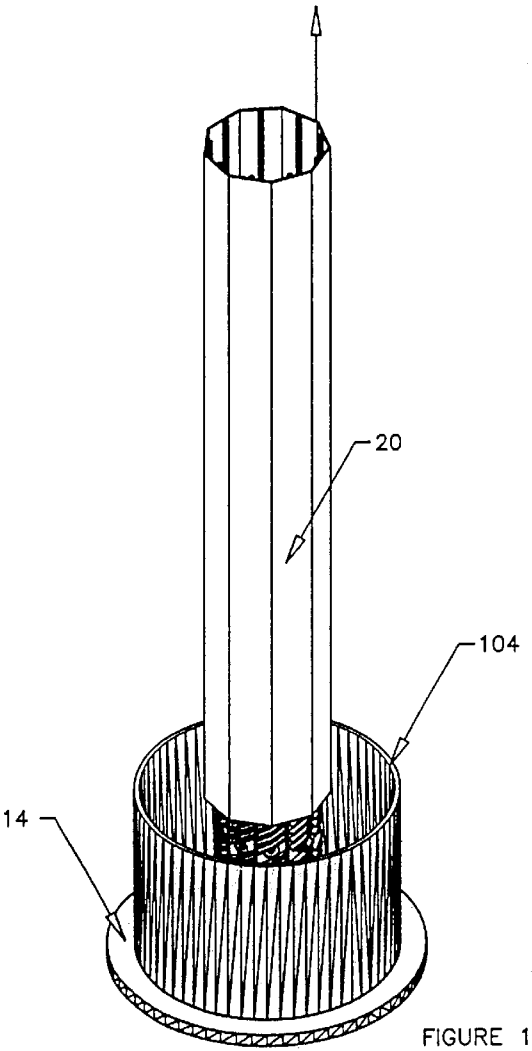
FIG. 13 is a perspective view of the boronizing apparatus illustrated in FIG. 12, showing the female housing being removed from the male housing after the boronizing cycle.
Figure 12:
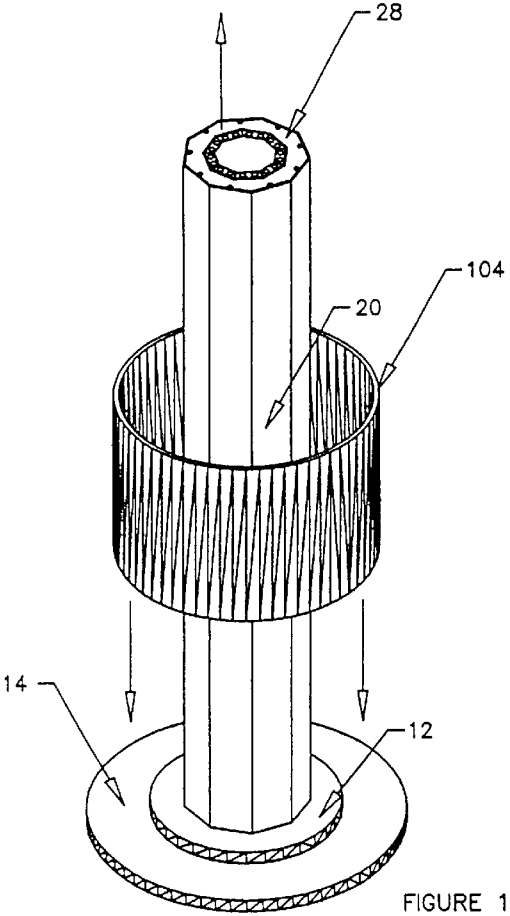
FIG. 12 is a perspective view of the boronizing apparatus illustrated in FIG. 11, showing a boronizing powder recycling ring being positioned to surround the female housing prior to disassembly after the boronizing cycle.

The use and operation of apparatus 10 in accordance with the teachings of the preferred method will now be described with reference to FIGS. 1 through 14. Referring to FIG. 5, workpieces 100 are mounted to male housing 16. Referring to FIG. 6, female housing 20 is then lowered into position overlying male housing 16, with a gravity seal being formed between female housing 20 and base 12. Referring to FIG. 7, pack powder 102 is then poured into annular workpiece receiving chamber 26, workpiece receiving chamber 26 and covering workpieces 100. It is preferred that workpiece receiving chamber 26 be filled in order to control movement of air. An expansion of gases occurs during heating. Filling workpiece receiving chamber 26 increases the boron potential of workpiece receiving chamber 26 during heating. Referring to FIG. 8, closure 28 is then positioned to close annular workpiece receiving chamber 26 and insulating covering 30 positioned to overlie female housing 20. Referring to FIG. 9, thermocouple 36 and 38 are then placed in position and are connected to programmable controller 44. Electrical conduit 46 is also attached to programmable controller 44. A boronizing cycle is then commenced with time and temperature monitored by programmable controller 44. Referring to FIG. 10, at the end of the boronizing cycle, thermocouple 36 and 38 are detached along with electrical conduit 46. Referring to FIG. 11, insulating cover 30 is removed in order to permit more rapid cooling of female housing 20. Referring to FIG. 12, when female housing 20 is cooled, boronizing powder recycling ring 104 is placed around female housing 20 in preparation for disassembly. Referring to FIG. 13, female housing 20 can then be raised to release spent powder into powder recycling ring 104 and permit access of workpieces 100. Referring to FIG. 14, treated workpieces 100 can be examined and tested as part of a quality control monitoring program. The spent powder captured in powder recycling ring 104 is recovered for the purpose of recycling. After each usage, however, a portion of the spent powder will have to be replaced with fresh powder in order to maintain boron potential when treating subsequent batches of workpieces.

It will be apparent to one skilled in the art that the key to the present invention is in demonstrating that the boronizing process can be carried on by introducing heat into an enclosed container, as opposed to placing an enclosed container into a furnace chamber. It will be apparent to one skilled in the art that modifications may be made to the illustrated embodiment without departing from the spirit and scope of the invention as hereinafter defined in the claims.

What is claimed is:

1. An apparatus for boronizing a metal workpiece, comprising:

a male housing containing a heating chamber;

a female housing having a sidewall defining an internal cavity, the male housing being insertable into the interior cavity of the female housing to form an annular workpiece and boronizing powder receiving chamber between the male housing and the sidewall of female housing.

2. The apparatus as defined in claim 1, wherein an internal heat source is disposed within the heating chamber.

3. The apparatus as defined in claim 2, wherein the internal heat source is an electric heating element.

4. The apparatus as defined in claim 1, wherein the male housing has a vertical orientation and the female housing overlies the male housing.

5. The apparatus as defined in claim 1, wherein the male housing is mounted in a substantially vertical orientation to a base.

6. The apparatus as defined in claim 1, wherein the female housing is covered by a removable insulating covering.

7. The apparatus as defined in claim 1, wherein temperature sensors are provided for monitoring temperature of at least one of the male housing and the female housing and the annular workpiece receiving chamber.

8. An apparatus for boronizing a metal workpiece, comprising:

a base;

a heat resistant male housing mounted in an upright orientation to the base;

a heating chamber disposed within the male housing;

an electric heating element disposed within the heating chamber of the male housing;

a heat resistant female housing having a sidewall defining an internal cavity, the female housing overlying the male housing with the male housing positioned in the internal cavity leaving an annular workpiece receiving chamber between the male housing and the sidewall of the female housing;

a closure closing the annular workpiece receiving chamber; and a removable insulating covering overlying the female housing.

9. The apparatus as defined in claim 8, wherein temperature sensors are provided for monitoring the temperature of at least one of the male housing and the female housing and the annular workpiece receiving chamber.

* * * * *